US006370794B1

(12) United States Patent
Tuggle

(10) Patent No.: US 6,370,794 B1
(45) Date of Patent: Apr. 16, 2002

(54) REVERSIBLE ELBOW FOR CONNECTING FLEXIBLE DUCT

(75) Inventor: W. Gregory Tuggle, Spring Lake, MI (US)

(73) Assignee: Builder's Best, Inc., Jacksonville, TX (US)

( * ) Notice: Subject to any disclaimer, the term of this patent is extended or adjusted under 35 U.S.C. 154(b) by 0 days.

(21) Appl. No.: 09/658,066

(22) Filed: Sep. 8, 2000

Related U.S. Application Data

(60) Provisional application No. 60/153,296, filed on Sep. 10, 1999.

(51) Int. Cl.[7] ..... F26B 19/00

(52) U.S. Cl. ..... 34/235; 34/140; 34/175; 34/606; 285/147.1; 285/181; 454/243; 454/270

(58) Field of Search ..... 34/601, 602, 604, 34/606, 607, 134, 138, 140, 175, 235; 285/147.1, 144.1, 168, 181, 182, 183; 454/243, 270, 367, 903

(56) References Cited

U.S. PATENT DOCUMENTS 5,145,217 A * 9/1992 Anderson et al. ..... 285/179
5,158,328 A * 10/1992 Anderson et al. ..... 285/168
5,819,435 A * 10/1998 Tuggle ..... 34/235
5,970,623 A * 10/1999 Tuggle ..... 34/134
6,098,312 A * 8/2000 Tuggle ..... 34/607
6,185,837 B1 * 2/2001 Tuggle ..... 34/134

* cited by examiner

*Primary Examiner*—Pamela Wilson
(74) *Attorney, Agent, or Firm*—McGarry Bair LLP

(57) ABSTRACT

An elbow for use in a dryer duct assembly comprising at least one component for connecting a dryer vent outlet and an exhaust vent. The component has an inlet and outlet. The dryer vent outlet and one of the component inlet and outlet have a standardized diameter. The elbow comprises a body defining an interior flow passage for permitting the passing of dryer exhaust air through the body. A first end of the body terminates in a first edge to define an inlet opening to the interior flow passage. A second end of the body terminates in a second edge to define an outlet opening to the interior flow passage. At least a portion of the first end has an effective inner diameter greater than the standardized diameter for receiving therein one of the dryer vent outlet and component inlet or outlet with the standardized diameter, and at least a portion of the second end has an effective outer diameter less than the standardized diameter for being received within the other of the dryer vent opening and component inlet or outlet with the standardized diameter.

47 Claims, 5 Drawing Sheets

REVERSIBLE ELBOW FOR CONNECTING FLEXIBLE DUCT

RELATED APPLICATION

This application claims priority on U.S. Provisional Patent Application No. 60/153,296 filed Sept. 10, 1999.

BACKGROUND OF THE INVENTION

1. Field of the Invention

This invention relates to exhaust vent systems, and more particularly to exhaust vent systems for clothes dryers having connections for attaching duct components to the dryer and to a vent opening in a wall.

2. Description of the Prior Art

Dryer exhaust conduits conduct substantial quantities of heated air and some lint from the dryer to an external location. Because of the amount of thermal energy involved in the vented air and in the dryer itself, dryer hose installation must be carefully made. Preferably, all-metal exhaust conduits are used throughout the dryer duct system. The conduits are usually solid wall construction or helical corrugation known as "flex" conduit, and have a large diameter opening on one end and a smaller diameter opening on another end, such that multiple conduits may be attached together through a telescopic fit. The conduits are generally secured together by use of a band clamp, which may have a tendency to crush the conduit.

One method of connection of multiple conduits is disclosed in U.S. Pat. No. 5,819,435, having the same assignee as the instant invention. In this method, each length of conduit has male and female opposing ends in the form of sleeves that are adapted to overlap, with a frictional fit, obviating the need for a clamp and avoiding crushing of the conduit. The method further includes a universal elbow connector normally having a female rotatable fitting on one end and a male rotatable fitting on the other end, each for receiving a duct component.

In most residential installations, the dryer is located against an exterior wall and the dryer exhaust is vented through the exterior wall to the atmosphere. Oftentimes, the dryer is located in a basement or other below-grade portion of the house. Since the dryer vent outlet is typically located near the bottom of the dryer a conduit is run from the bottom of the dryer to an above-grade portion of the exterior wall. An elbow is commonly used to redirect the dryer exhaust upwardly from the dryer bottom. The conduit connects the elbow to the exterior vent.

In any telescopic connection, it is preferred that no edges or other sharp surfaces inside the conduits face the direction of air flow so as to avoid the collection of lint along the edge or surface. Lint collection and retention within the conduit can restrict the flow of air through the conduit, which can degrade the performance of the dryer, and create a potential fuel source in the event of a dryer fire.

The conduits used in either of the prior art methods require connection, at one end, to the vent outlet of the dryer being vented, and at the other end to an exterior exhaust vent which allows air to pass from the room wherein the dryer is located. While the interface built into the dryer has become standardized in the industry, presenting a predictable connection to the manufacturer and installer of the dryer venting, the interface of the exhaust vent, often built into the house, however, has been found to vary by region and by builder, and cannot be relied upon to be of a uniform dimension. This results in the manufacturer having to manufacture connectors of multiple sizes, requiring additional inventory management, or in the alternative, restricting itself out of those markets. The installer is required to carry connectors of differing sizes, also creating a storage and inventory management problem.

It would be advantageous to provide a single product that would be adaptable to connect flexible dryer duct of a given size with exhaust vents of slightly differing configurations or sizes. It would be desirable that such a product would not require additional adapters, thereby avoiding the waste of at least one adapter from every product package. It would be desirable that the product would not require excessive modification by the installer, thereby avoiding a loss of productivity. It is also desirable that the connection not have any surfaces that face the exhaust air flow direction to deter the accumulation of lint.

SUMMARY OF THE INVENTION

The invention relates to an elbow for use in a dryer duct assembly comprising at least one component for connecting a dryer vent outlet and an exhaust vent. The component has an inlet and outlet. The dryer vent outlet and one of the component inlet and outlet have a standardized diameter. The elbow comprises a body defining an interior flow passage for permitting the passing of dryer exhaust air through the body. A first end of the body terminates in a first edge to define an inlet opening to the interior flow passage. A second end of the body terminates in a second edge to define an outlet opening to the interior flow passage. At least a portion of the first end has an effective inner diameter greater than the standardized diameter for receiving therein one of the dryer vent outlet and component inlet or outlet with the standardized diameter, and at least a portion of the second end has an effective outer diameter less than the standardized diameter for being received within the other of the dryer vent opening and component inlet or outlet with the standardized diameter.

In another aspect, the invention relates to a dryer duct assembly for connecting a dryer vent outlet with a standardized diameter and an exhaust vent. The dryer duct assembly comprises a duct and an elbow. The duct having an inlet and an outlet, with both the duct inlet and outlet having a diameter equal to the standardized diameter. The elbow comprises a hollow body defining an interior flow passage for permitting the passing therethrough of dryer exhaust air, the body having an inlet opening and an outlet opening. The inlet opening has an effective diameter nominally greater than the standardized diameter for insertion of the dryer vent outlet therein and the outlet opening has an effective diameter nominally less than the standardized diameter for being slidably received within the duct inlet.

BRIEF DESCRIPTION OF THE DRAWINGS

The invention will now be described with reference to the drawings wherein.

DESCRIPTION OF THE PREFERRED EMBODIMENTS

Figure 1:
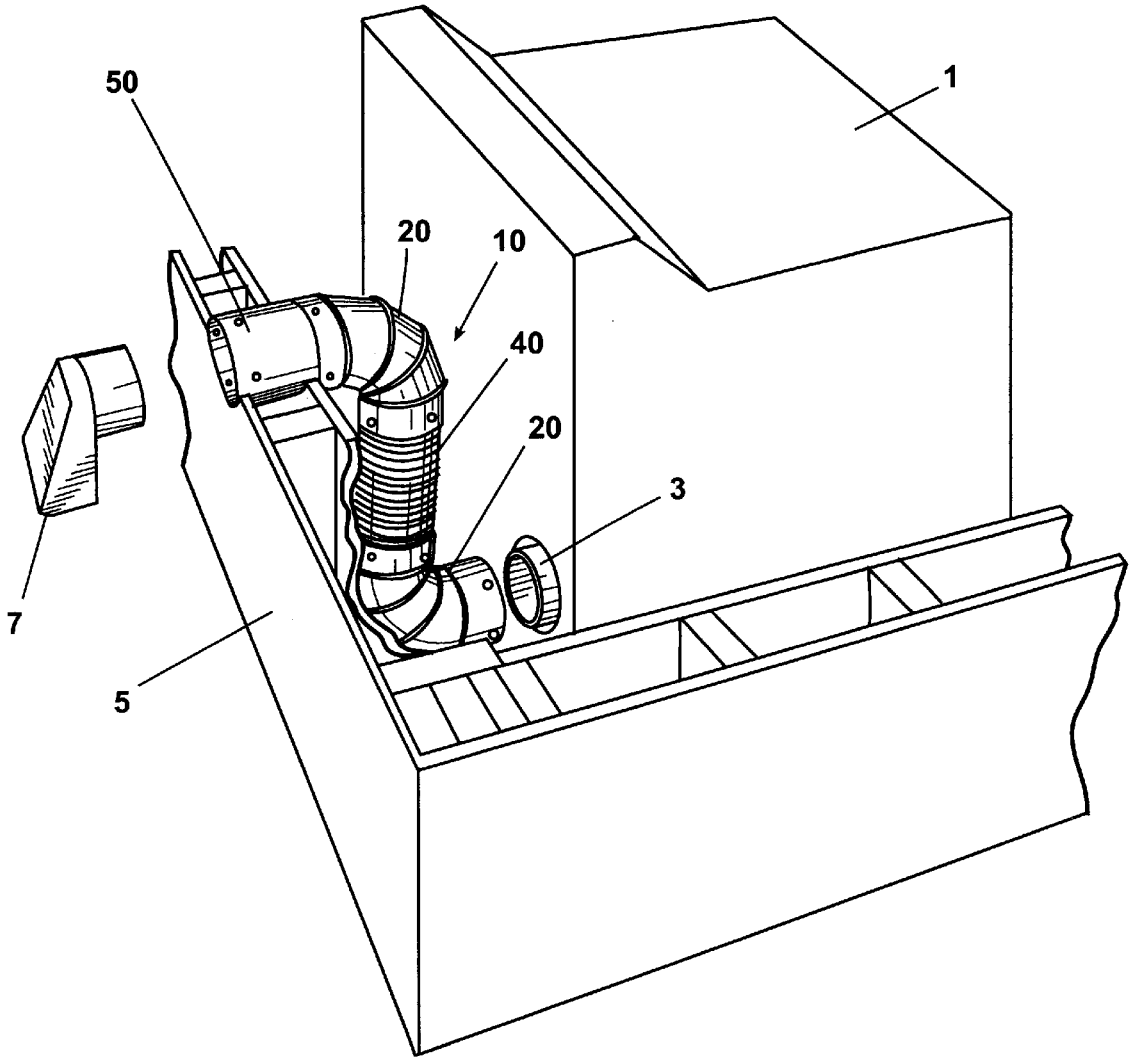
FIG. 1 is a perspective view of a dryer duct assembly of the present invention shown for attachment between an exterior vent and a dryer vent outlet.

Referring to FIG. 1, a dryer 1 has a dryer exhaust 3 that is connected by a dryer exhaust duct assembly 10 to an exterior vent 50. The dryer exhaust preferably has a standardized diameter, which is current approximately 4 inches. The dryer duct assembly 10 comprises a first elbow 20 connecting the dryer exhaust 3 to a flexible conduit 40 which, through a second elbow 20, is fluidly connected with the vent 50, here depicted as a through-wall exhaust vent. The vent 50 passes through a wall 5 and is capped by an exterior deflector 7 that generally will direct the exhaust flow downward, the downward opening also preventing rain or other articles from entering vent 50.

Figure 2:
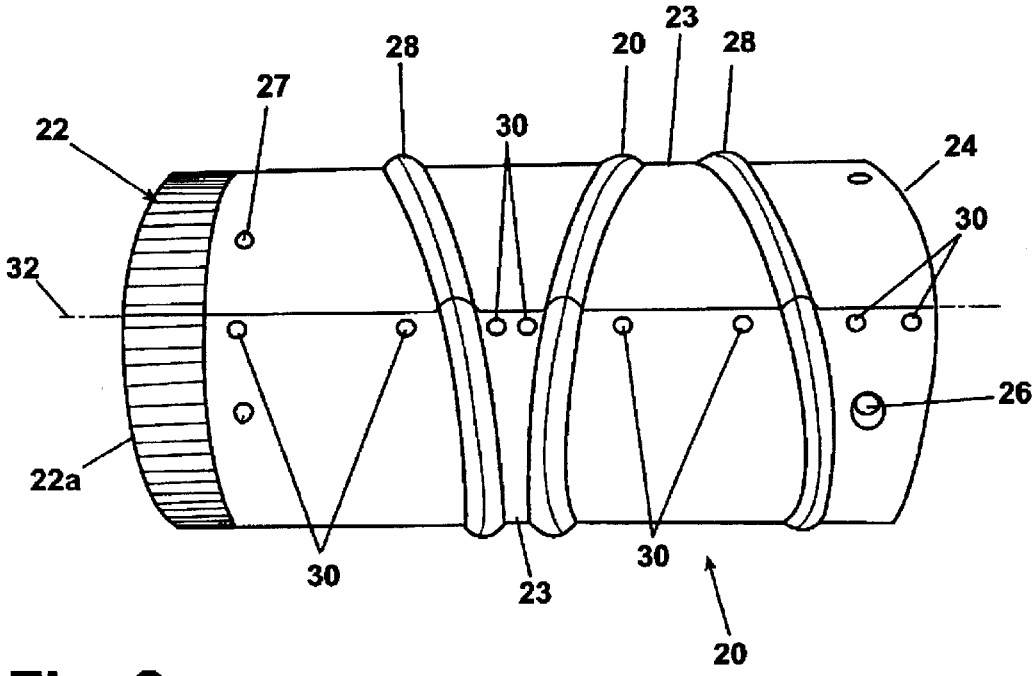
FIG. 2 is a side view of a reversible elbow, according to the invention, in a straight configuration.
Figure 3:
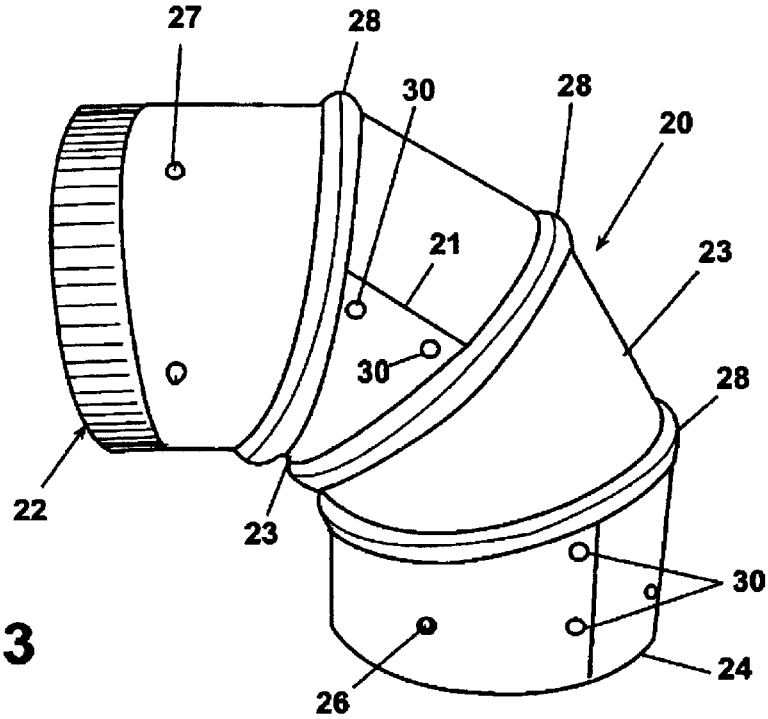
FIG. 3 is a side view of the reversible elbow, according to the invention, in a 90° configuration.

Turning now to FIGS. 2 and 3, the elbow 20 is manufactured in a conventional manner from a single flat sheet of aluminum or other lightweight sheet metal. The sheet is rolled into a tube having a continuous taper, with a narrow end 22 and a wide end 24, and retained in that configuration by a plurality of rivets 30. The slightly tapering tube is cut into sections along joints 28, adjacent sections are overlapped, and the joints 28 are rolled to produce a rotatable interface in a well known manner. Effectively, each of the joints becomes a swivel or rotatable joint about which adjacent sections can be rotated relative to each other.

The joints are disposed at an angle relative to a longitudinal axis 32 of the tube, such that, the sections can be oriented in a first position where they are axially aligned (FIG. 2) and upon rotating the sections 180° relative to each other about the longitudinal axis 32 of the tube, the ends of the tube are angularly spaced 90° to form a 90° elbow.

In this preferred embodiment, each section provides an angular displacement of approximately 22 ½° for a resultant 90° elbow upon rotation of the individual sections with respect to each other. Directly opposing longitudinal score lines are etched into the surface of the tube to aid in aligning the tube sections. Upon rotating the sections 180° with respect to each other, the opposing score lines will align to aid in getting an exact 90° angle from the elbow.

Referring to FIGS. 2–5, the tube is divided into four sections: a narrow tapered end 22; two interior sections 23; and a tapered wide end 24. The narrow tapered end has an edge 22*a* that defines an outlet opening 22*b*, which is fluidly connected to the hollow interior of the tube. Similarly, the wide tapered end 24 has an edge 24*a* that defines an outlet opening 24*b*, which is fluidly connected to the hollow interior of the tube. Since the tube is preferably continuously tapered, the narrow tapered end 22 continuously narrows from the adjacent interior section 23 to the edge 22*a* and the wide tapered end 24 continuously narrows from the edge 24*a* to the adjacent interior section 23. While the elbow 20 is tapered from the wide end 24 down to the tapered end 22, the tapered end 22 is also crimped to provide additional tapering.

Internally directed dimples 26 are provided in the surface of the material adjacent the wide end 24. Outwardly projecting dimples 27 are provided adjacent the tapered end 22. The dimples 26 and 27 change the effective diameter of that portion of the corresponding end 24 and 22. The dimples 26, 27 are preferably formed in the tube and are compressible if sufficient force is applied. The dimples enhance the frictional interference between the ends 22, 24 of the elbow and any parts of the duct assembly 10 connected to the ends.

It should be noted that the tapered shape of the tube provides the ends 22, 24 with a continuously decreasing actual diameter from the inlet opening 24*b* to the outlet opening 22*b*. The continuously decreasing nature of the actual diameter along the ends 22, 24 increases the utility of the elbow in that the ends 22, 24 can inserted into or receive components of the duct assembly having of different diameters while still providing a strong interference fit. The dimples 27, 26 alter the effective diameter of the ends 22, 24 at the axial location of the dimples, effectively increasing the diameter of the end 22 and decreasing the diameter of the end 24.

Figure 4:
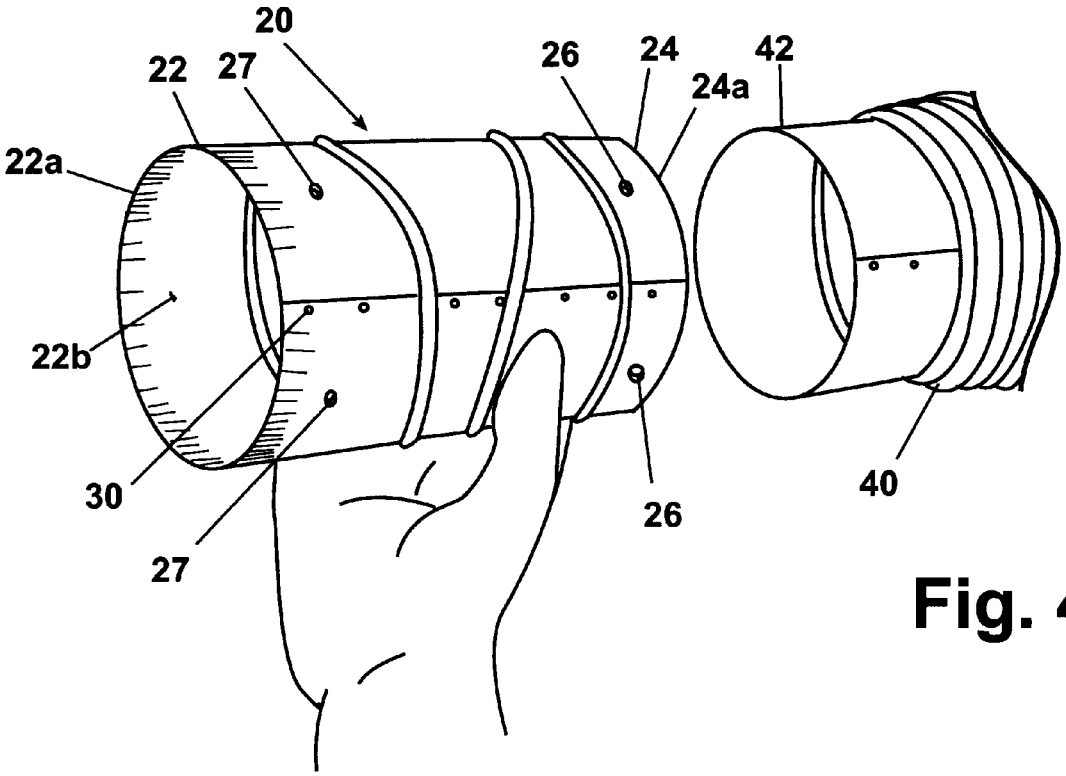
FIG. 4 depicts attachment of the reversible elbow to a flexible conduit.
Figure 5:
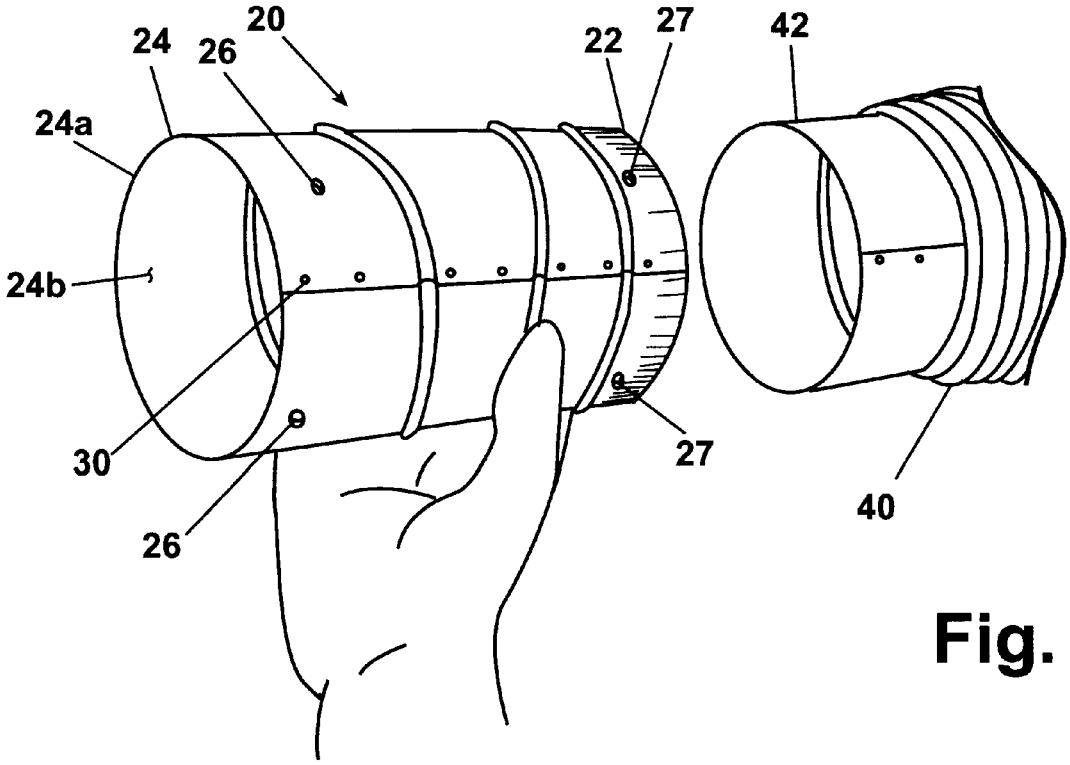
FIG. 5 depicts an alternative attachment of a reversible elbow to a flexible conduit.

Turning now to FIG. 4, flexible conduit 40 comprises a conduit end sleeve 42, dimensioned so as to slidably fit inside the tapered wide end 24 of the elbow 20, and be frictionally held by the dimples 26. In the alternative, FIG. 5, the same sleeve 42 can fit over the tapered end 22 of the elbow 20 and be frictionally held by the dimples 27. Preferably, the sleeves have a diameter equal to the dryer exhaust opening, which is typically standardized at 4 inches. However, for the invention to function, it is only necessary that the sleeve received within the wide end 24 have an outer diameter less than the inner diameter of the wide end 24 at the edge 24*a* and the sleeve received over the narrow end 22 have an inner diameter greater than the outer diameter of the narrow end 22 at the edge 22*a*.

Figure 6:
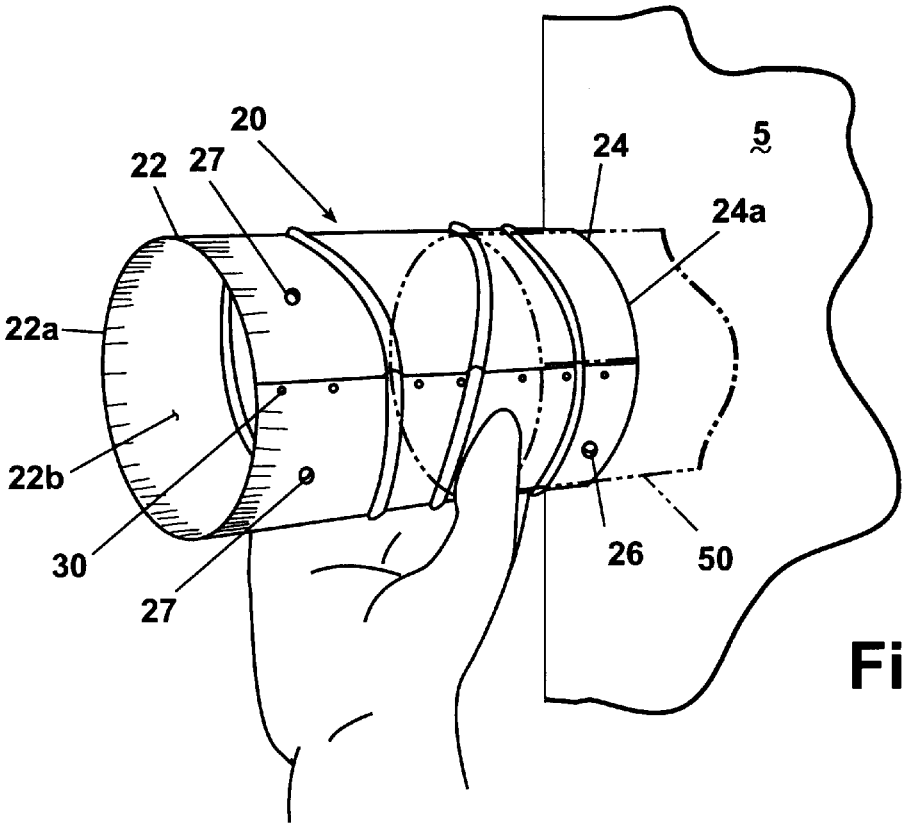
FIG. 6 depicts an attachment of a reversible elbow to a through-wall exhaust vent.
Figure 7:
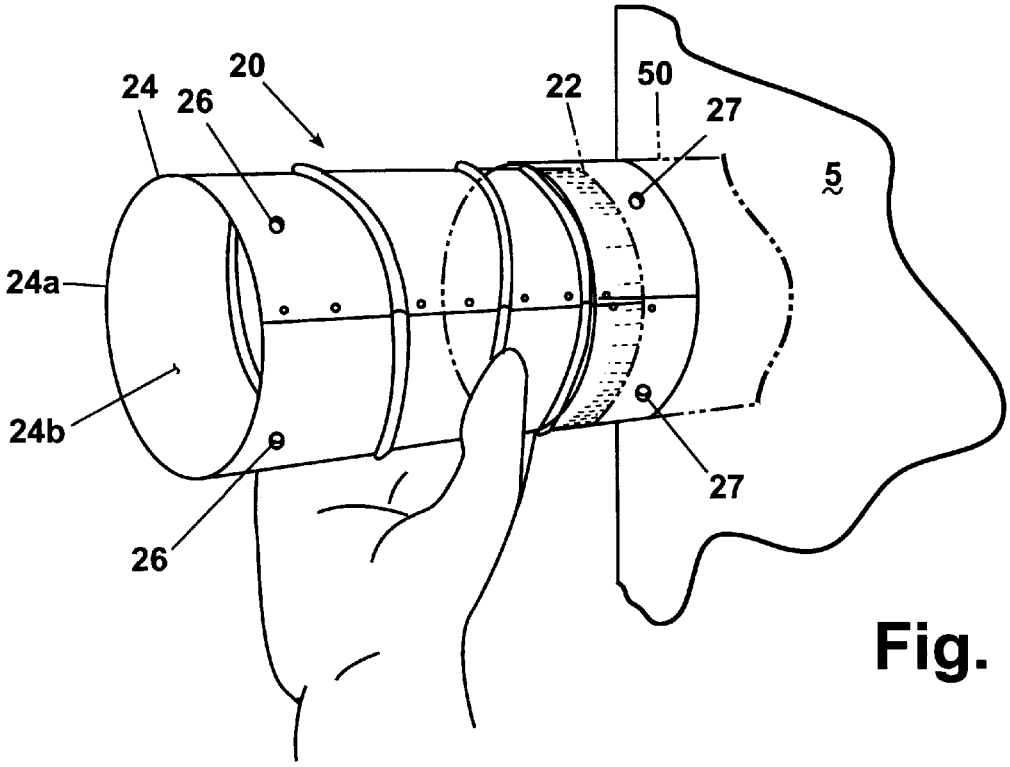
FIG. 7 depicts an alternative attachment of a reversible elbow to a through-wall exhaust vent.

FIG. 6 depicts how the elbow 20 can connect the conduit 40 and the vent 50 where vent 50 has an outer diameter larger than the inner diameter of the elbow end 22. In this configuration, the wide end 24 receives the vent 50 and the sleeve 42 is slidably received over the narrow end 22. This assembly is not preferred since the edge 22*b* faces the exhaust air flow direction. FIG. 7 depicts the preferred assembly, which is the reverse of FIG. 6, where the vent 50 has an outer diameter smaller than the inner diameter of the elbow end 22. In the preferred configuration the wide end 24 of the elbow 20 receives the sleeve 42 of the conduit 40 and the tapered end 22 slides into the vent 50. In the preferred configuration, no edge of the elbow faces into the exhaust air flow.

Even though the elbow according to the invention has a preferred assembly direction so that no edge faces the air flow, the elbow can be reversed to connect various components of the duct assembly to accommodate different diameters.

It should be noted that the elbow sections can be rotated to their desired positions before or after the elbow is connected to the duct assembly components. To prevent the twisting of the duct, it is preferred that the elbow be sections be rotated as needed to obtain the desired curvature prior to connection to the duct assembly components.

In the first embodiment described above, and depicted in FIG. 1., a "kit" used by an installer to connect the dryer exhaust 3 to the vent 50 would consist of a single section of conduit 40, having a sleeve 42 on each end, and two elbows 20. A first elbow 20 would be attached to the dryer exhaust 3, and a second elbow 20 attached to the vent 50, with the flexible conduit 40 attached therebetween. An alternative embodiment to this installation would have a conduit 40 with one end sleeve 42. As before, the sleeve 42 is adapted to fit either within the wide end 24 or around the tapered end 22 of the elbow 20. The opposing end of the conduit 40 would have an elbow 20 affixed, the exposed end of the elbow 20 being sized to connect to the dryer exhaust 3.

Figure 8:
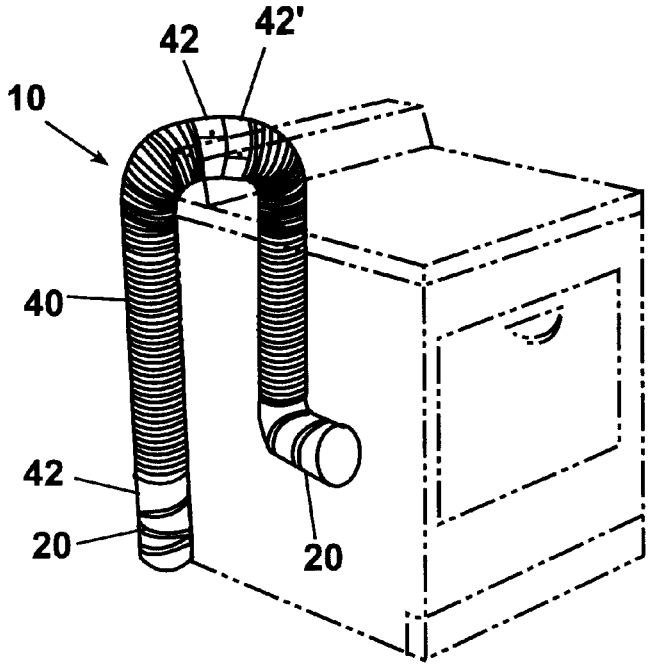
FIG. 8 is a perspective view of an alternative installation of an assembly of multiple conduit sections to a through-floor vent.
Figure 9:
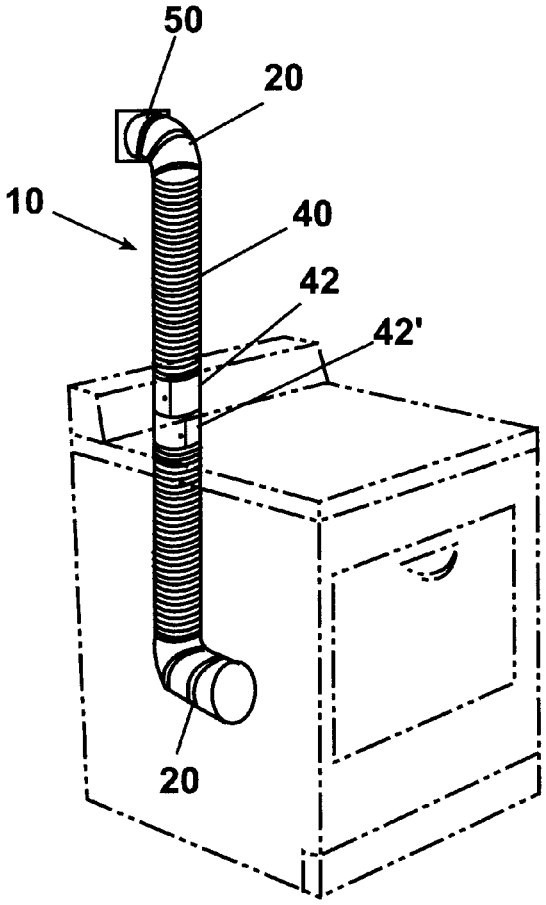
FIG. 9 is a perspective view of an alternative installation of an assembly of multiple conduit sections to a through-wall vent.

Additional alternative embodiments are depicted in FIG. 8 and 9. Both of these embodiments comprise a first section of conduit 40 comprising a first end to which has been affixed a first elbow 20 as described above. A second end of the first section of conduit 40 terminates in an end sleeve 42'. The end sleeve 42' differs from the previously described end sleeve 42 in that it has been crimped so as to fit inside, and thereby form a friction-type connection with, an end sleeve 42. A second section of conduit 40, having end sleeves 42 on opposite ends of the second conduit 40, is slidably and frictionally fitted onto the first section of conduit 40 at the end sleeve 42'. To this assembly is attached a second elbow 20, as above, the end sleeve 42 of the second section of conduit 40 being adapted to slide either onto the tapered end 22 or into the wide end 24 of the elbow 20. In FIG. 8 the reversible elbow 20 is shown in the straight configuration of FIG. 2, adapted to connect to a vent 50 which passes through a floor. In FIG. 9, the elbow 20 is in the 90° configuration, terminating, as in FIG. 1, at a vent 50 in the form of a through-wall exhaust vent.

While the invention has been specifically described in connection with certain specific embodiments thereof, it is to be understood that this is by way of illustration and not of limitation. For example, the elbow can have more or less segments. Indeed, a non-segmented elbow having one end slightly longer than the other end is within the scope of this invention. Moreover, the taper need not be continuous over the axial direction of a segment or the entire elbow. It is sufficient for the taper to occur within a short axial direction, so long as a sharp face is no presented to the air flow within the elbow.

I claim:

1. An elbow for use in a dryer duct assembly comprising at least one component for connecting a dryer vent outlet and a remote exhaust vent, the component having an inlet and outlet, and the dryer vent outlet and one of the component inlet and outlet each having the same standardized diameter, the elbow comprising:

a body defining an interior flow passage for permitting the passing of dryer exhaust air from the dryer vent outlet through the body, the body having:

a first end terminating in a first edge to define an inlet opening to the interior flow passage; and a second end terminating in a second edge to define an outlet opening to the interior flow passage;

wherein at least a portion of the first end has an effective inner diameter nominally greater than the standardized diameter for receiving therein one of the dryer vent outlet and the one of the component inlet or outlet with the standardized diameter, and wherein at least a portion of the second end has an effective outer diameter nominally less than the standardized diameter for being received within the other of the dryer vent opening and the one of the component inlet or outlet with the standardized diameter whereby the elbow can be reversibly connected between the dryer vent and the one of the component inlet or outlet.

2. The elbow according to claim 1 wherein the effective inner diameter varies along a portion of the length of the first end.

3. The elbow according to claim 2 wherein the effective inner diameter continuously varies along the length of the first end.

4. The elbow according to claim 3, and further comprising at least one dimple extending from the first end into the hollow interior of the body and the dimple defining a discrete variation in the effective inner diameter.

5. The elbow according to claim 3 wherein the effective inner diameter continuously decreases from the inlet opening.

6. The elbow according to claim 5 wherein the inlet opening has a diameter greater than the standardized diameter to form the at least one portion of the first end having an inner diameter greater than the standardized diameter.

7. The elbow according to claim 6 wherein the effective outer diameter continuously varies along the length of the second end.

8. The elbow according to claim 7 and further comprising at least one dimple extending from the first end away from the hollow interior of the body and the dimple defining a discrete variation in the effective outer diameter.

9. The elbow according to claim 7 wherein the effective outer diameter of the second end continuously decreases toward the outlet opening.

10. The elbow according to claim 9 wherein the outlet opening has a diameter less than the standardized diameter to form the at least one portion of the first end having an outer diameter less than the standardized diameter.

11. The elbow according to claim 1 wherein the first and second ends each have a portion along which the effective inner and outer diameters vary, respectively.

12. The elbow according to claim 11 wherein the effective inner and outer diameters continuously vary along the portion of the length of the first and second ends, respectively.

13. The elbow according to claim 12 wherein the first end portion begins at the inlet opening and the effective inner diameter continuously decreases therefrom, and the second end portion terminates at the outlet opening and the effective outer diameter continuously decreases toward the outlet opening.

14. The elbow according to claim 1 wherein the body has a substantially truncated cone-shape with a generally decreasing diameter from the inlet opening to the outlet opening.

15. The elbow according to claim 14 wherein the inlet opening has a diameter greater than the standardized diameter.

16. The elbow according to claim 15 wherein the outlet opening has a diameter less than the standardized diameter.

17. The elbow according to claim 16 wherein the standardized diameter is about four inches.

18. The elbow according to claim 16 wherein the body comprises first, second, third and fourth sections, the first and forth sections forming the first and second ends, with the first and second sections rotatably coupled together, the second and third sections rotatably coupled together, and the third and fourth sections rotatably coupled together, such that the relative rotation of the sections permits the elbow to have a curvature between 0 and 90 degrees.

19. The elbow according to claim 18 and further comprising dimples extending from the first section into the interior flow passage.

20. The elbow according to claim 19 and further comprising dimples extending from the second section away from the interior flow passage.

21. The elbow according to claim 1 wherein the body comprises first, second, third and fourth sections, the first and forth sections forming the first and second ends, with the first and second sections rotatably coupled together, the second and third sections rotatably coupled together, and the third and fourth sections rotatably coupled together, such that the relative rotation of the sections permits the elbow to have a curvature between 0 and 90 degrees.

22. A dryer duct assembly for connecting a dryer vent outlet with a standardized diameter and an exhaust vent, comprising:

a duct having an inlet and an outlet, with both the duct inlet and outlet having a diameter equal to the standardized diameter;

an elbow comprising a hollow body defining an interior flow passage for permitting the passing therethrough of dryer exhaust air, the body having an inlet opening and an outlet opening;

wherein the inlet opening has an effective diameter nominally greater than the standardized diameter for insertion of the dryer vent outlet therein and the elbow outlet opening has an effective diameter nominally less than the standardized diameter for being slidably received within the duct inlet.

23. The duct assembly according to claim 22 wherein the body has a substantially truncated cone-shape with a generally decreasing diameter from the inlet opening to the outlet opening.

24. The duct assembly according to claim 23 wherein the body comprises first, second, third and fourth sequentially aligned sections, the first section defining the inlet opening, the forth section defining the outlet opening, with the first and second sections rotatably coupled, the second and third sections rotatably coupled, and the third and fourth sections rotatably coupled such that the relative rotation of the sections permits the elbow to have a curvature between 0 and 90 degrees.

25. The duct assembly according to claim 24 wherein the first section has an effective inner diameter that varies along the length of the first section.

26. The duct assembly according to claim 25 wherein the effective inner diameter varies discretely along the length of the first section.

27. The duct assembly according to claim 25 wherein the effective inner diameter continuously varies along the length of the first end defining a discrete variation in the effective outer diameter.

28. An elbow for use in a dryer duct assembly comprising at least one component for connecting a dryer vent outlet and a remote exhaust vent, the component having an inlet and outlet, and the dryer vent outlet and one of the component inlet and outlet each having the same standardized diameter, the elbow comprising:

a body defining an interior flow passage for permitting the passing of dryer exhaust air from the dryer vent outlet through the body, the body having:

a first end terminating in a first edge to define an inlet opening to the interior flow passage; and a second end terminating in a second edge to define an outlet opening to the interior flow passage;

wherein at least a portion of the first end has an effective inner diameter nominally greater than the standardized diameter for receiving therein one of the dryer vent outlet and the one of the component inlet or outlet with the standardized diameter and the effective inner diameter of the first end varies along a portion of the length of the first end, and wherein at least a portion of the second end has an effective outer diameter nominally less than the standardized diameter for being received within the other of the dryer vent opening and the one of the component inlet or outlet with the standardized diameter so that the elbow can be reversibly connected between the dryer vent and the one of the component inlet or outlet.

29. The elbow according to claim 28 wherein the effective inner diameter continuously varies along the length of the first end.

30. The elbow according to claim 29, and further comprising at least one dimple extending from the first end into the hollow interior of the body and the dimple defining a discrete variation in the effective inner diameter.

31. The elbow according to claim 29 wherein the effective inner diameter continuously decreases from the inlet opening.

32. The elbow according to claim 31 wherein the inlet opening has a diameter greater than the standardized diameter to form the at least one portion of the first end having an inner diameter greater than the standardized diameter.

33. The elbow according to claim 32 wherein the effective outer diameter continuously varies along the length of the second end.

34. The elbow according to claim 33 and further comprising at least one dimple extending from the first end away from the hollow interior of the body and the dimple defining a discrete variation in the effective outer diameter.

35. The elbow according to claim 33 wherein the effective outer diameter of the second end continuously decreases toward the outlet opening.

36. The elbow according to claim 35 wherein the outlet opening has a diameter less than the standardized diameter to form the at least one portion of the first end having an outer diameter less than the standardized diameter.

37. An elbow for use in a dryer duct assembly comprising at least one component for connecting a dryer vent outlet and a remote exhaust vent, the component having an inlet and outlet, and the dryer vent outlet and one of the component inlet and outlet each having the same standardized diameter, the elbow comprising:

a body defining an interior flow passage for permitting the passing of dryer exhaust air from the dryer vent outlet through the body, the body having:

a first end terminating in a first edge to define an inlet opening to the interior flow passage; and a second end terminating in a second edge to define an outlet opening to the interior flow passage;

wherein at least a portion of the first end has an effective inner diameter nominally greater than the standardized diameter for receiving therein one of the dryer vent outlet and the one of the component inlet or outlet with the standardized diameter, and wherein at least a portion of the second end has an effective outer diameter nominally less than the standardized diameter for being received within the other of the dryer vent opening and the one of the component inlet or outlet with the standardized diameter whereby the elbow can be reversibly connected between the dryer vent and the one of the component inlet or outlet, and wherein the first and second ends each have a portion along which the effective inner and outer diameters vary, respectively.

38. The elbow according to claim 37 wherein the effective inner and outer diameters continuously vary along the portion of the length of the first and second ends, respectively.

39. The elbow according to claim 38 wherein the first end portion begins at the inlet opening and the effective inner diameter continuously decreases therefrom, and the second end portion terminates at the outlet opening and the effective outer diameter continuously decreases toward the outlet opening.

40. An elbow for use in a dryer duct assembly comprising at least one component for connecting a dryer vent outlet and a remote exhaust vent, the component having an inlet and outlet, and the dryer vent outlet and one of the component inlet and outlet each having the same standardized diameter, the elbow comprising:

a body defining an interior flow passage for permitting the passing of dryer exhaust air from the dryer vent outlet through the body, the body having:

a first end terminating in a first edge to define an inlet opening to the interior flow passage; and a second end terminating in a second edge to define an outlet opening to the interior flow passage;

wherein at least a portion of the first end has an effective inner diameter nominally greater than the standardized diameter for receiving therein one of the dryer vent outlet and the one of the component inlet or outlet with the standardized diameter, and wherein at least a portion of the second end has an effective outer diameter nominally less than the standardized diameter for being received within the other of the dryer vent opening and the one of the component inlet or outlet with the standardized diameter whereby the elbow can be reversibly connected between the dryer vent and the one of the component inlet or outlet, and wherein the body has a substantially truncated cone-shape with a generally decreasing diameter from the inlet opening to the outlet opening.

41. The elbow according to claim 40 wherein the inlet opening has a diameter greater than the standardized diameter.

42. The elbow according to claim 41 wherein the outlet opening has a diameter less than the standardized diameter.

43. The elbow according to claim 42 wherein the standardized diameter is about four inches.

44. The elbow according to claim 42 wherein the body comprises first, second, third and fourth sections, the first and forth sections forming the first and second ends, with the first and second sections rotatably coupled together, the second and third sections rotatably coupled together, and the third and fourth sections rotatably coupled together, such that the relative rotation of the sections permits the elbow to have a curvature between 0 and 90 degrees.

45. The elbow according to claim 44 and further comprising dimples extending from the first section into the interior flow passage.

46. The elbow according to claim 45 and further comprising dimples extending from the second section away from the interior flow passage.

47. An elbow for use in a dryer duct assembly comprising at least one component for connecting a dryer vent outlet and a remote exhaust vent, the component having an inlet and outlet, and the dryer vent outlet and one of the component inlet and outlet each having the same standardized diameter, the elbow comprising:

a body defining an interior flow passage for permitting the passing of dryer exhaust air from the dryer vent outlet through the body, the body having:

a first end terminating in a first edge to define an inlet opening to the interior flow passage; and a second end terminating in a second edge to define an outlet opening to the interior flow passage;

wherein at least a portion of the first end has an effective inner diameter nominally greater than the standardized diameter for receiving therein one of the dryer vent outlet and the one of the component inlet or outlet with the standardized diameter, at least a portion of the second end has an effective outer diameter nominally less than the standardized diameter for being received within the other of the dryer vent opening and the one of the component inlet or outlet with the standardized diameter whereby the elbow can be reversibly connected between the dryer vent and the one of the component inlet or outlet, and the body comprises first, second, third and fourth sections, the first and forth sections forming the first and second ends, with the first and second sections rotatably coupled together, the second and third sections rotatably coupled together, and the third and fourth sections rotatably coupled together, such that the relative rotation of the sections permits the elbow to have a curvature between 0 and 90 degrees.

* * * * *